US006283930B1

(12) United States Patent
Purvis et al.

(10) Patent No.: US 6,283,930 B1
(45) Date of Patent: Sep. 4, 2001

(54) TRAVEL MASSAGE BRUSH

(75) Inventors: Grant David Purvis, Miramar (NZ); David M. Raffo, Chester (GB); Troy Gene Anderson, Marblehead, MA (US); Rudy Anthony Vandenbelt, Ottawa (CA)

(73) Assignee: Headwaters Research & Development, Inc., Ottawa (CA)

( * ) Notice: Subject to any disclaimer, the term of this patent is extended or adjusted under 35 U.S.C. 154(b) by 0 days.

(21) Appl. No.: 08/944,286

(22) Filed: Oct. 6, 1997

(51) Int. Cl.[7] ..... A61H 7/00

(52) U.S. Cl. ..... 601/137; 601/136; 601/72; 601/70; 601/69; 15/185; 15/202; 15/203

(58) Field of Search ..... 601/46, 67, 69, 601/70, 80, 81, 136, 137, 134, 135; 15/185, 202, 203, 22.1

(56) References Cited

U.S. PATENT DOCUMENTS

| | | | | |
|---|---|---|---|---|
| 1,592,510 | * | 7/1926 | Toepperwein | 151/185 |
| 2,676,347 | | 4/1954 | Hershey . | |
| 2,806,235 | | 9/1957 | Carstairs et al. . | |
| 3,358,309 | * | 12/1967 | Richardson | 15/22 |
| 3,427,674 | | 2/1969 | Tone et al. . | |
| 3,648,321 | * | 3/1972 | Vallis | 15/185 |
| 3,782,395 | | 1/1974 | Sarna . | |
| 3,870,056 | | 3/1975 | Stemme . | |
| 4,118,823 | * | 10/1978 | Axelrod | 15/202 |
| 4,987,633 | * | 1/1991 | Heneveld | 15/185 |
| 5,320,125 | * | 6/1994 | Barnhar | 132/313 |
| 5,335,390 | * | 8/1994 | Chen | 15/185 |
| 5,382,107 | * | 1/1995 | Nian | 15/185 |
| 5,471,695 | * | 12/1995 | Aiyar | 15/22.1 |
| 5,511,270 | | 4/1996 | Eliachar et al. . | |

* cited by examiner

*Primary Examiner*—Michael A. Brown
*Assistant Examiner*—Benjamin K. Koo
(74) *Attorney, Agent, or Firm*—Albert Peter Durigon

(57) ABSTRACT

The disclosed travel massage brush is an ultra-compact vibrating hair brush that comfortably fits an average woman's or man's hand in the hair brushing or massage modes. It is light in weight and portable permitting grooming and/or soothing scalp or body massage anywhere, at any time. Pivotally connected vibratory brush-head and handle subassemblies provide maximum space saving portability, making the travel massage brush ideal for taking along to the gym, to work, or while traveling. The vibratory brush-head subassembly includes a bristle carrier that is removably attached to a base member thereof and preferably slides on and off the base member to allow for convenient bristle cleaning and to access the battery compartment. Gentle ball-tipped bristles stimulate circulation to hair follicles. A vibratory motion imparter with two separate speeds mounted to the base member of the brush-head subassembly provides an effective scalp massage to stimulate blood circulation to hair follicles, and works as a detangler for healthier, better looking hair. Two separate sets of massage ridges provide an invigorating pinpoint massage or a soothing area massage. The travel massage brush is cordless, and may be used anywhere, at anytime, and runs for hours on a single "AA" battery.

5 Claims, 4 Drawing Sheets

TRAVEL MASSAGE BRUSH

FIELD OF THE INVENTION

This invention is drawn to the field of hair care apparatus, and more particularly, to a novel travel massage brush.

BACKGROUND OF THE INVENTION

Massage brushes are known to provide effective scalp massage to stimulate blood circulation to hair follicles. By doing so, hair receives vital nutrients necessary for healthy growth and a lustrous sheen. The massage action also helps to detangle the thickest hair without hair breakage and may be used for wet or dry hair.

U.S. Pat. Nos. 2,676,347; 2,806,235; 3,427,674; 3,870,056; 3,782,395; and 5,511,270 are exemplary of the heretofore known massage brushes. The '347 patent discloses a "military" style (handle-less) scalp brush having mating modules enclosing a power-operated reciprocating member, and a brush mounted thereto for back-and-forth reciprocating movement. The '235 patent discloses a vibrating hairbrush having a shell that houses a power-operated vibratory member and a brush attached to the bottom of the shell. In one embodiment, a handle rigidly extends from the shell, while another embodiment is "military" style. The '674 patent discloses a power-operated hairbrush having an elongated drive housing graspable by hand and a brush head mounted thereto that includes brush bristles positioned therein for extension and retraction thru aligned openings in the head as the latter rotates. The '056 patent discloses reciprocating combs in a hair detangling device having a rigid handle. The '395 patent discloses a battery-powered hair teasing device having an eccentric that rocks an extending brush member side-to-side about a pivot. The '270 patent discloses a battery-operated hair detangling brush having a brush head mounted for sliding and rotary motion relative to the axis of an elongated handle.

The utility of the heretofore known massage brushes has been limited in that they have been cumbersome to use and otherwise not compact; have required AC outlet access and otherwise have not been portable; their mechanisms have been complicated, and they have been composed of multiple, and thus costly, component parts; their bristles have been subject to crushing and otherwise have not been damage resistant; their brush heads have not been interchangeable; and/or once their brush-heads have been soiled with use, it has not been easy to clean their bristles.

SUMMARY OF THE INVENTION

Accordingly, it is one principal object of the present invention to provide a travel massage brush that is compact, portable, easy to use and maintain, and is damage resistant. In accord therewith, the disclosed travel massage brush includes a vibratory brush-head subassembly having outwardly extending bristles, a battery-powered vibratory motion imparter, and a user-accessible switch for actuating the vibratory motion imparter. The disclosed travel massage brush further includes a handle subassembly contoured to fit comfortably in the hand; and a mechanical articulation subassembly connecting the handle subassembly and the vibratory brush-head subassembly for motion between a closed position and an open position.

In the closed position, the handle subassembly covers the outwardly extending bristles of the vibratory brush-head subassembly, protecting them against unintentional damage, from lint and dirt pick-up, and from catching, for example, on the lining of a bag or luggage. In the open position, the handle subassembly extends from the vibratory brush-head subassembly serving as a user-manipulatable handle.

The travel massage brush of the present invention in its open condition is of compact size, comparable to that of a standard hair brush, and is selectably operable as a hair brush, as a vibrating hair brush, and as a massager. In its closed condition, the travel massage brush of the invention is of compact size comparable to that of a standard pocket comb, making it readily portable in bag or pocket, and is selectably operable as a massager.

In the preferred embodiment, the handle subassembly includes an elongated, generally cupshaped member defining a hollow that receives the bristles of the vibratory brush-head subassembly when it is in its closed position. A mirror member is mounted in the hollow of the elongated, generally cup-shaped member of the handle subassembly, which allows the user to groom themselves. At least a portion of the mirror member may be magnified to allow the user to better groom themselves.

In the preferred embodiment, the mechanical articulation includes a spring-biased pivot hinge pivotally connecting the handle subassembly and the vibratory brush-head subassembly for pivotal motion between the closed and opened positions. The spring imparts a bias that needs be overcome whenever it is moved from its open to its closed condition, and from its closed to its open condition.

It is another principal object of the present invention to provide a travel massage brush that is compact and portable, that has interchangeable heads, and that has easy to clean bristles. In accord therewith, the disclosed travel massage brush of the present invention includes a brush-head subassembly comprised by a vibratory base member having a battery-powered vibratory motion imparter, a user-accessible switch for activating the vibratory motion imparter, and an exposed face for receiving a detachable carrier; and is further comprised by a detachable carrier removably mounted, preferably for sliding motion, to the exposed face of the vibratory base member. The detachable carrier is easy to clean whenever it is detached from the exposed face of the vibratory brush-head subassembly, and it is easy to replace it after cleaning.

The detachability of the detachable carrier permits interchange of different carriers on the exposed face of the vibratory brush-head subassembly. In the preferred embodiment, the detachable carrier is a nylon bristle carrier, although a natural bristle carrier and/or, among others, a massage finger carrier could be employed.

In the preferred embodiment, the detachable carrier includes a pliant substrate and the battery powered vibratory motion imparter includes a battery receiving compartment integrally formed along the exposed face of the vibratory base member. Whenever the bristle carrier is in place on the vibratory brush-head subassembly, the pliant substrate captures the battery and helps to retain it in the battery receiving compartment, dampens vibration whenever the brush-head subassembly is operative in massage mode, and helps to lock-out moisture damage to the vibratory motion imparter and the other components carried in the base member of the vibratory brush-head subassembly. In addition, the curvature of the captured battery helps to impart to the pliant substrate, and therewith to the bristles carried thereby, the curvature characteristic of the vibratory brush head subassembly. In this manner, the pliant substrate of the carrier performs multiple functions, resulting in a novel brush-head subassembly that is simple in construction with attendant lowered manufacturing costs.

BRIEF DESCRIPTION OF THE DRAWINGS

These and other objects, inventive aspects, and advantageous features of the present invention will become apparent as the invention becomes better understood by referring to the following description of the presently preferred embodiments, and to the drawings, wherein.

DETAILED DESCRIPTION OF THE PREFERRED EMBODIMENTS

Figure 1:
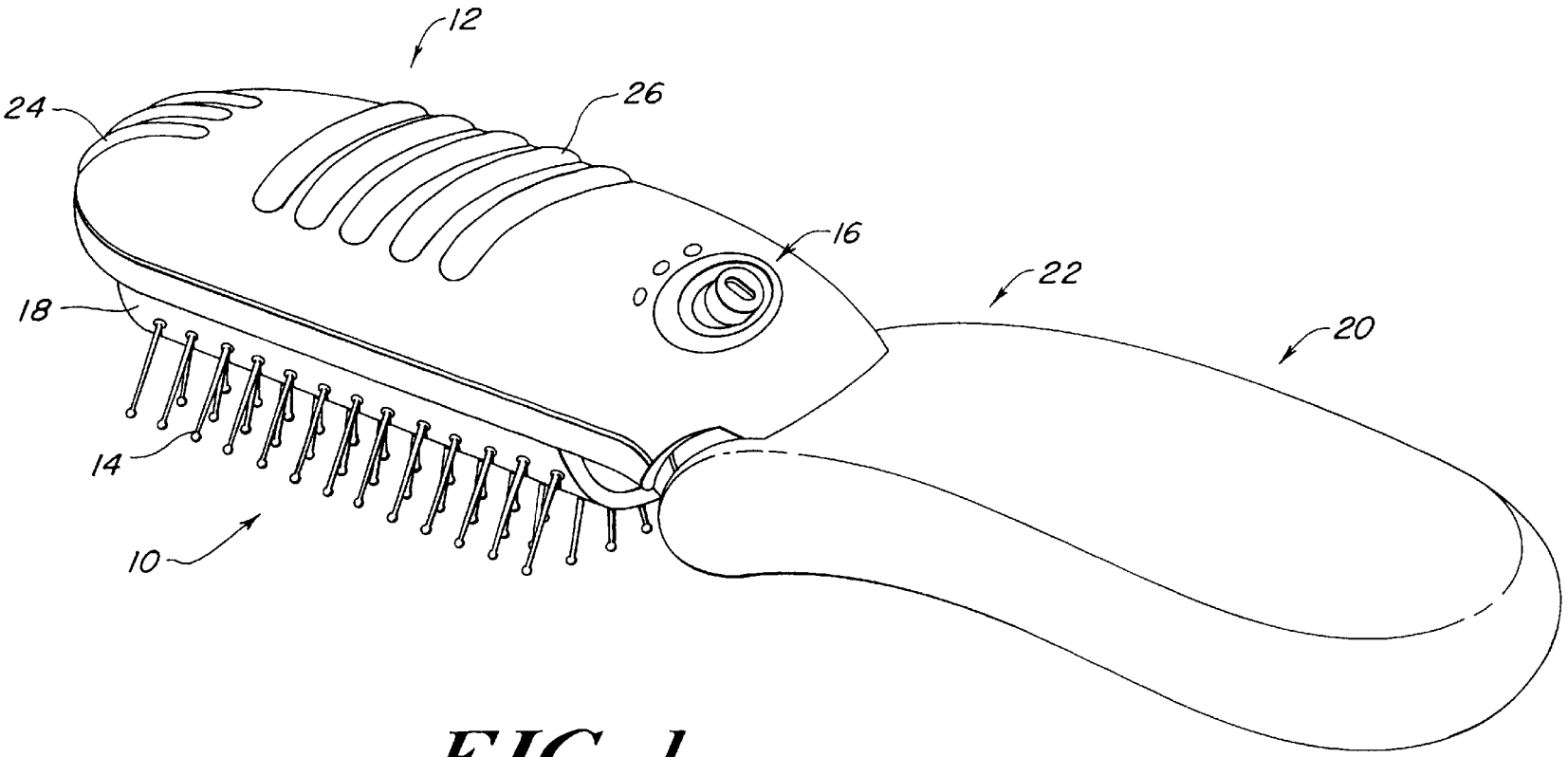
FIG. 1 is an isometric view showing the back and one side of the novel travel massage brush of the present invention in its open condition.

Referring now to FIG. 1, generally designated at 10 is an isometric view showing the back and one side of the novel travel massage brush of the present invention in its open condition. The travel massage brush 10 includes a vibratory brush-head subassembly generally designated 12 having outwardly extending bristles 14, preferably of nylon, a battery-powered vibratory motion imparter to be described, not shown, and a user-accessible switch subassembly generally designated 16 for actuating the vibratory motion imparter. The bristles 14 are carried by a bristle carrier 18 that is removably mounted, preferably for sliding motion in a manner to be described, to the vibratory brush-head subassembly 12, permitting it to be cleaned periodically during use. As appears more fully below, the removably mounted bristle carrier 18, in addition,. cooperates with the brush-head subassembly 12 to help secure a battery received therewithin, and the curvature of the secured battery helps to impart the curvature characteristic of the bristle carrier, and therewith of the brush-head, of the vibratory brush-head subassembly.

Figure 2:
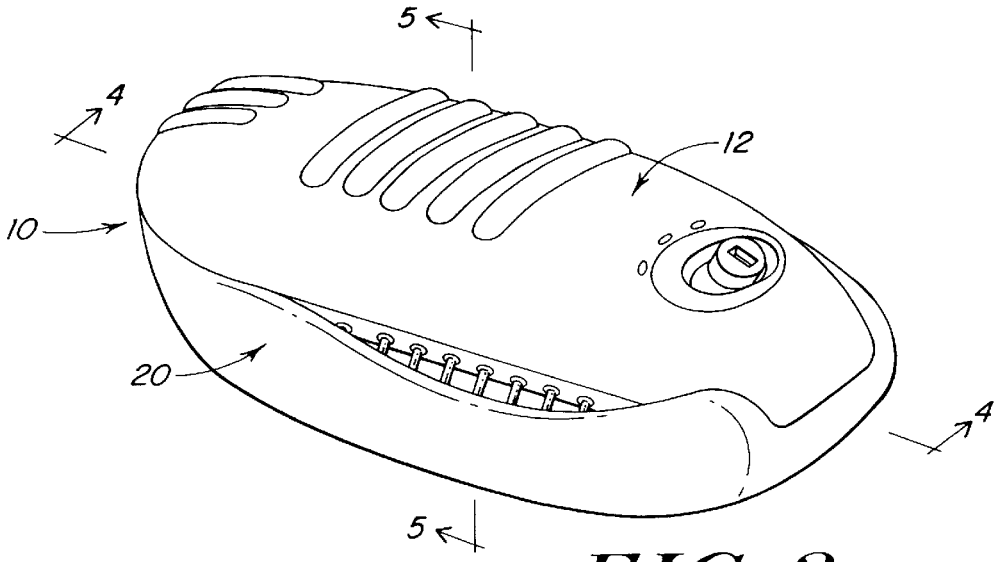
FIG. 2 is an isometric view showing the back and the same side of the travel massage brush of the present invention in its closed condition.

A handle subassembly generally designated 20 contoured to comfortably fit in the hand is connected to the vibratory brush-head subassembly 12 via a mechanical articulation generally designated 22, preferably a pivot hinge to be described, for movement between the illustrated open position, where the handle subassembly 20 extends from the brush-head subassembly 12 serving as a user manipulable handle, and a closed position, where the handle subassembly 20 covers the outwardly extending bristles of the vibratory brush-head subassembly 12, protecting them against unintended damage, as best seen in FIG. 2. In the closed position, the handle also prevents dust and lint build-up, and prevents the bristles from catching the lining of a bag or other chamber in which it may be placed.

As appears more fully below, the handle subassembly 20 is preferably generally cup-shaped, and defines a hollow that receives the bristles when the travel massage brush of the present invention is in its closed condition. A mirror to be described is preferably mounted in the hollow of the generally cup-shaped handle subassembly 20 to allow the user to groom themselves when the travel massage brush is in its open condition. The mirror may be of ordinary or greater magnification. A compartment or other attachment member, not shown, may be provided for a nail file or the like in the hollow of the generally cup-shaped handle subassembly 20.

Longitudinally extending ribs 24, preferably three (3) in number, are provided on the nose of the vibratory brush-head subassembly 12 to provide concentrated vibrations to specific joints or muscle areas (e.g., to relieve pain from repetitive motion activities), and larger, transverse ribs 26, preferably five (5) in number, are provided about the mid-body of the back of the vibratory brush-head subassembly 12 to provide relief to wider muscle regions (e.g., for soothing aching muscles after physical activity). Other rib configurations and locations could of course be employed.

User-accessible switch subassembly 16 preferably includes a two-position switch to be described enabling the user to select massage at either high or low speeds in a manner to be described. In the preferred embodiment, the switch 16 is so located as to be accessible from both the closed and open conditions, enabling the user to select massage action when the brush is either open or closed. Other switch subassemblies and placements, with or without manual or automatic switch actuation mechanisms, and operation at one (1), two (2) or more speeds could be employed.

Figure 3:
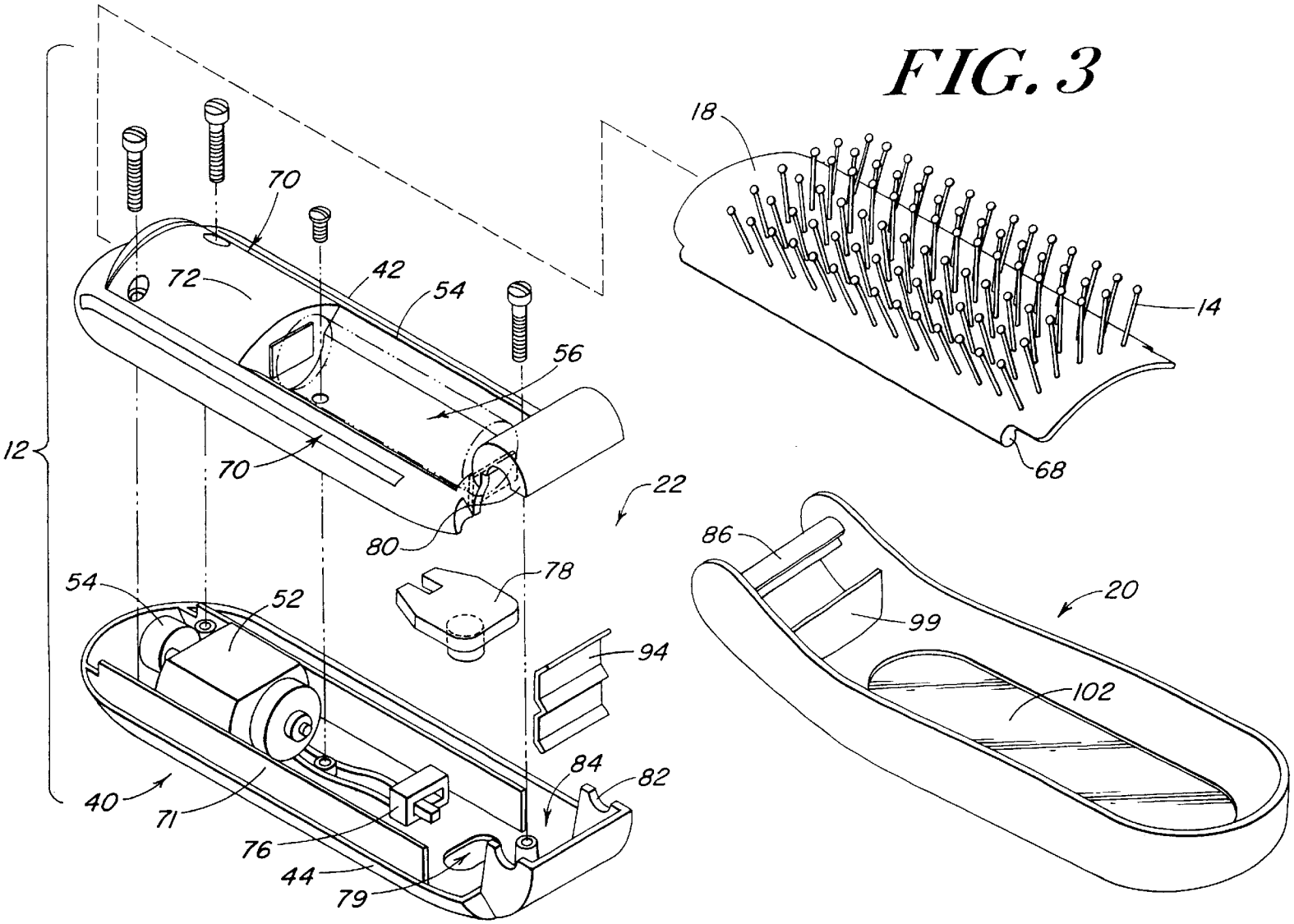
FIG. 3 is an exploded perspective view showing the front and the other side of the travel massage brush of the present invention in its open condition.
Figure 4:
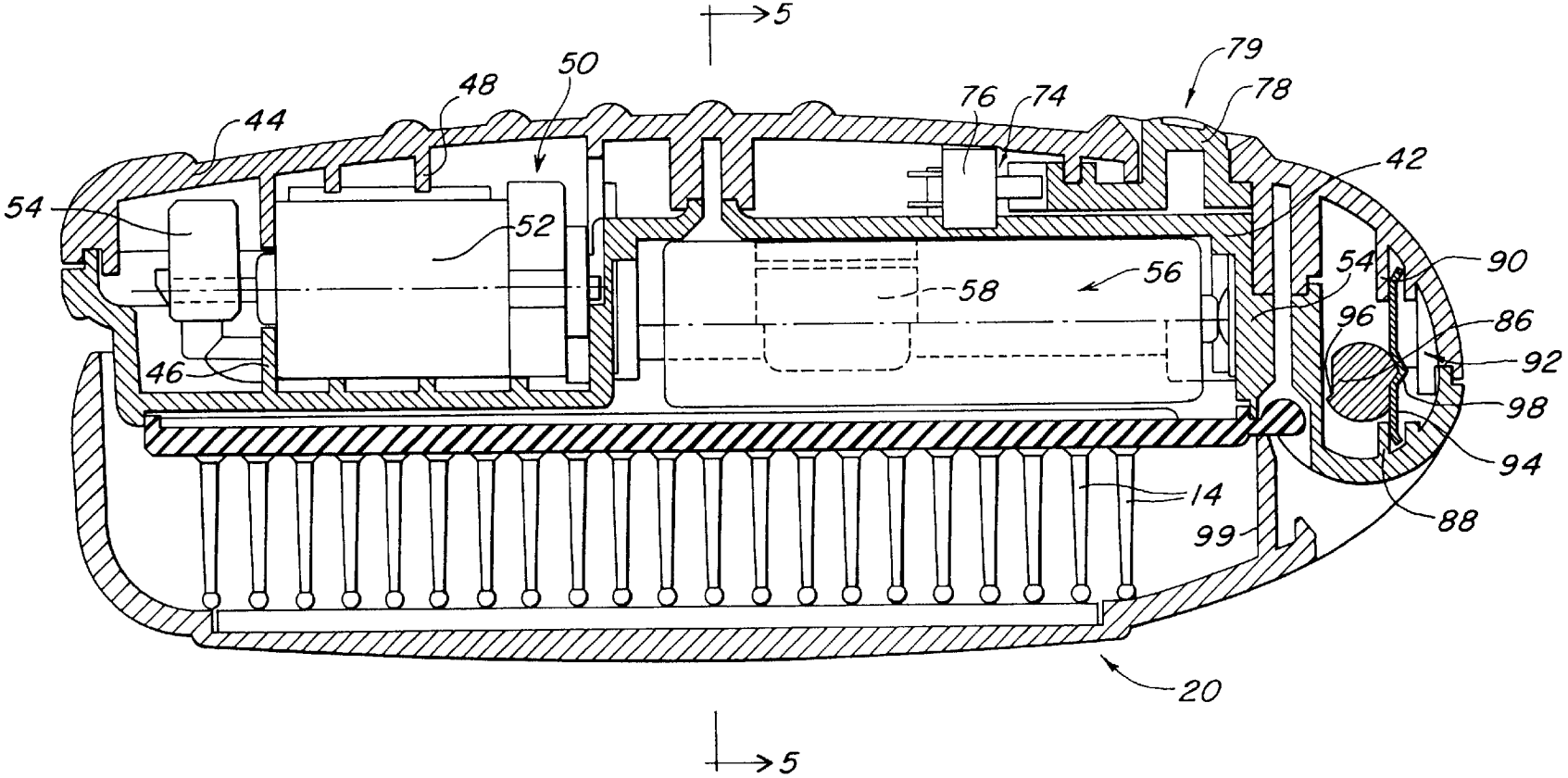
FIG. 4 is a longitudinal sectional view of the travel massage brush of the present invention in its closed condition along the lines 4—4 of FIG. 2.

Referring now to FIG. 3 generally designated at 40 is an exploded perspective view showing the front and the other side of the travel massage brush of the present invention. The vibratory brush-head subassembly 12 includes mating inner and outer body halves 42, 44 that preferably are integrally formed by any suitable plastic forming technique. Upstanding walls 46, 48 integrally formed on the inner and outer body halves 42, 44 provide a motor receiving cavity generally designated 50 as best seen in FIG. 4, and motor 52, having an eccentric 54 mounted for rotation with its shaft, is frictionally retained in the motor receiving cavity 50. The cavity 50 is offset towards the nose of the vibratory brush-head subassembly 12 and the motor 52 is oriented therein with the eccentric 54 confronting the nose so as to impart greater vibration to the ribs 24 (FIG. 1) and lesser vibration to the ribs 26 (FIG. 1). The location of the cavity and orientation of the eccentric may be varied, of course, to impart any desired vibration characteristics. The motor 52 is wrapped with a foam liner, not shown, to control the oscillation, or rattling, of the motor 52 in the cavity 50.

Upstanding walls 54 are integrally formed with the inner body half 42 and provide a battery receiving cavity generally designated 56. Integrally-formed battery retaining clips 58 best seen in FIG. 4 are provided along the sidewalls of the battery receiving compartment 56. The clips 58 are angled inwardly to frictionally retain a battery received therewithin. The battery clips also serve to control the oscillation, or rattling, of the battery during massage mode operation.

As will be readily appreciated by those of skill in the art, as the eccentric 54 is turned by the motor 52 it produces vibrations, and induces vibratory motion throughout the vibratory brush-head subassembly 12, mechanical articulation 22, and handle subassembly 22.

Figure 5:
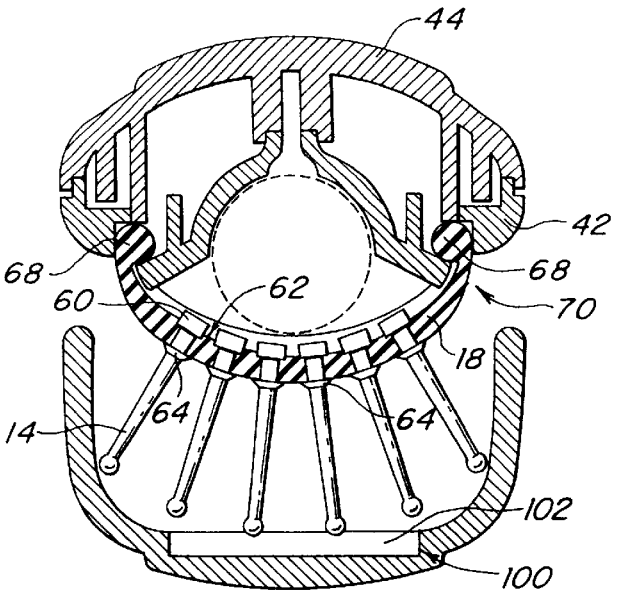
FIG. 5 is a transverse sectional view of the travel massage brush of the present invention in its closed condition along the lines 5—5 of FIG. 2.

Bristles 14 are preferably of nylon and are preferably ball-tipped to provide an effective scalp massage to stimulate blood circulation to hair follicles, and preferably are mounted in six (6) rows of nineteen (19) bristles to the bristle carrier 18. Each row of bristles includes an elongated backing strip 60 received in longitudinally-extending recess generally designated 62 provided therefor in bristle carrier 18, and conically-shaped flanges 64 provided on each bristle 14 of cross-section larger than the cross-section of the corresponding opening provided therefor in bristle carrier 18 retain the same therewithin, as best seen in FIG. 5. Although the bristles may be individually mounted, the longitudinal strips 60 help to provide structure and to maintain a uniform curvature along the length of the bristle carrier 18. The bristles in aligned rows could also be offset in rows or mounted in any other suitable pattern.

Although nylon bristles are preferred, natural bristles may also be employed, as well as massage finger bristles. Other carrier configurations may also be employed.

The bristle carrier 18 preferably is a generally-rectangular strip of a suitable pliant material, such as rubber, and longitudinally extending flanges 68 of a cross-sectional dimension greater than the thickness of the carrier 18 are provided along the lateral edges thereof As best seen in FIG. 5, walls defining longitudinally-extending slots generally designated 70 of width slightly larger than the thickness of the bristle carrier 18 extend to either side of, and longitudinally along, the inner body half 42.

The bristle carrier 18 is removably attached to the inner body half 42 by slidably moving the flanges 68 in and out along the longitudinally-extending slots 70 provided therefor. Although a slidably mounted bristle carrier is preferred, other removably attached carriers could be employed. If more than one carrier is provided, then the same or different carriers may readily be interchanged on the vibratory head subassembly 12.

The pliancy of the carrier 18 allows the bristles to flex when in use and allows the brush-head to adjust to the natural contour of the head when brushing. In brush massage mode, the pliant bristle carrier 18 also acts to soften the vibrations during use. When detached, the bristle carrier may be readily cleaned and replaced, and when attached, it not only serves to help capture the battery in the battery receiving compartment and takes part of its curvature therefrom, but also helps to protect the battery compartment from moisture ingress. Transverse ribs, not shown, are provided on the underside of the bristle carrier 18 to prevent accidental removal of the carrier when brushing.

Upstanding, longitudinally extending rails 71 integrally formed with the outer body half 44 in confronting relation with the mid-axis of the slots 70 serve not only to help guide the flanges 68 of the bristle carrier 18 during sliding motion, but also cooperate with the pliant bristle carrier 18 to provide a partial seal against moisture ingress to the electrical and metal components in the mating housing halves 42, 44.

The inner body half 42 includes a curved wall 72 which, in cooperation with the curved wall, best seen in FIG. 5, of the battery received in the longitudinally adjacent battery-receiving compartment 56, impart to the pliant bristle carrier 18 the curvature characteristic of the vibratory brush-head subassembly 12.

Confronting upstanding walls, not shown, integrally formed on the inner and outer body halves 42, 44, define a switch receiving cavity generally designated 74 as best seen in FIG. 4, and a double-pole, single-throw switch 76 is frictionally retained in the switch receiving cavity 74 provided therefor. A switch actuator 78 laterally connected to the toggle of the double-pole, single-throw switch 76 is user-accessible through opening generally designated 79 provided therefor in body half 44 as best seen in FIG. 4.

Mating half-cylinders 80, 82 integrally formed on confronting ends of the inner and outer body halves 42, 44 cooperate to provide a bearing race generally designated 84, and a transversely-extending axle 86 integrally formed at the confronting end of the handle subassembly 20 is received within the bearing race 84 to provide a pivot hinge. Upstanding walls 88 integrally formed with the half-cylinder 80, and confronting upstanding walls 90 integrally formed with the half cylinder 82, cooperate to provide a spring receiving cavity generally designated 92 as best seen in FIG. 4, and a spring member 94 is captured in the spring receiving cavity 92. The axle 86 is provided with detents 96, 98 that cooperate with the spring 92 to impart resistance that needs to be overcome whenever the travel massage brush is moved from its closed to its open position, and whenever it is moved from its open to its closed position. Wall 99 is provided on handle subassembly 20 to prevent access to the brush (or other) head when it is moved to its closed condition, as best seen in FIG. 4.

The body of handle subassembly 20 is generally cup-shaped and dimensioned to receive the bristles 14 when it is in its closed position. The bottom of the cup-shaped handle member is provided with a recess generally designated 100 as best seen in FIG. 5, and a mirror 102 is securely mounted in the recess 100, such as by any suitable adhesive. The mirror 102 allows the user to better groom themselves when the handle subassembly 20 is in its open position.

Figure 6:
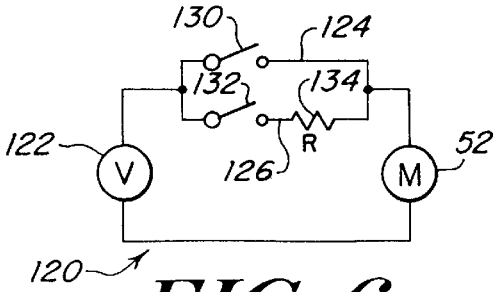
FIG. 6 is an electrical schematic diagram of the user accessible switch and battery powered vibratory motion imparter of the travel massage brush of the present invention.

Referring now to FIG. 6, generally designated at 120 is an schematic diagram of the electrical circuitry of the travel massage brush of the present invention. The motor 52 is electrically connected to the battery compartment electrodes and therewith to the potential source 122 marked "V" via parallel circuit paths 124, 126. Switches 130, 132 are connected in series in the parallel circuit legs 124, 126, and a resistor 134 marked "R" is connected in series with the switch 132 in the circuit path 126. The switches are normally in their "open" condition. When the switch 132 is actuated but not the switch 130, the motor 52 operates at a first speed determined by the voltage drop produced across the resistor 134. When the switch 130 is actuated, it shorts the path through the switch 132, and the potential applied across the motor 52 is the full potential of the voltage source 122. The motor 52 runs at a correspondingly higher speed.

Many modifications of the presently disclosed invention will become apparent to those of skill in the art who have benefited from the instant disclosure without departing from the inventive concepts.

What is claimed is:

1. A vibratory head subassembly for a massage brush that is compact and portable, that is easy to clean, and that permits ready interchange of different heads, comprising:

a vibratory base member having a battery-powered vibratory motion imparter mounted in said base including a motor having an axle to which a weight is eccentrically mounted so as to produce vibrations when said axle is turned by said motor, a switch for actuating said motor of the vibratory motion imparter, and an exposed, external face for receiving a detachable bristle carrier and having a well for receiving at least one battery for said motor of said battery-powered vibratory motion imparter; and a detachable bristle carrier of pliant material removably mounted to said exposed, external face of said vibratory base member to easily permit its ready cleaning when removed from said exposed, external face of said vibratory base member and to cover and help retain said at least one battery in said well and dampen battery vibration when it is mounted to said exposed, external face of said vibratory base member and said switch has actuated said motor to produce vibrations, the detachable bristle carrier of pliant material when mounted to said exposed, external face receiving at least a part of its characteristic curvature from said battery when it is received in said well.

2. The travel massage brush of claim 1, wherein said detachable carrier is a bristle carrier having outwardly extending bristles and that includes a pliant member, wherein the battery powered vibratory motion imparter includes a battery receiving compartment along said exposed face of said base member, and wherein the pliant member of said bristle carrier is slidably mounted to said exposed face of said base member and serves not only to help secure batteries positioned within the battery receiving compartment but takes its characteristic curvature at least in part from the curvature of the battery received therewithin.

3. The travel massage brush of claim 2, further including a handle subassembly mechanically articulated to said vibratory base member for motion between a closed position, where said handle subassembly covers the outwardly extending bristles of the bristle carrier when it is slidably mounted to said vibratory base member, protecting them against unintended damage and from dirt and lint pick-up, and an open position, where said handle subassembly extends from the vibratory base member serving as a user manipulable handle.

4. The travel massage brush of claim 3, handle subassembly includes an elongated, generally cup-shaped member defining a hollow that receives the bristles when it is said closed position.

5. The travel massage brush of claim 3, further including a mirror member mounted to said handle subassembly to permit grooming when it is in said open position.

* * * * *